US008887952B2

(12) United States Patent
Spivey, Sr.

(10) Patent No.: US 8,887,952 B2
(45) Date of Patent: Nov. 18, 2014

(54) CARTON WITH AN IMPROVED DISPENSING FEATURE

(71) Applicant: Graphic Packaging International, Inc., Atlanta, GA (US)

(72) Inventor: Raymond Rudolph Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/963,418

(22) Filed: Aug. 9, 2013

(65) Prior Publication Data

US 2013/0320034 A1 Dec. 5, 2013

Related U.S. Application Data

(63) Continuation of application No. 13/662,876, filed on Oct. 29, 2012, now Pat. No. 8,579,154, which is a continuation of application No. 13/357,997, filed on Jan. 25, 2012, now Pat. No. 8,302,811, which is a continuation of application No. 13/094,962, filed on Apr. 27, 2011, now Pat. No. 8,123,072, which is a continuation of application No. 12/406,537, filed on Mar. 18, 2009, now Pat. No. 7,946,451, which is a continuation of application No. 11/470,428, filed on Sep. 6, 2006, now Pat. No. 7,523,842, which is a continuation of application No. 10/959,870, filed on Oct. 6, 2004, now Pat. No. 7,175,047, which is a continuation of application No. 10/777,614, filed on Feb. 12, 2004, now Pat. No. 7,100,798, which is a continuation of application No. 10/425,846, filed on Apr. 29, 2003, now Pat. No. 6,715,639, which is a continuation of application No. 09/757,714, filed on Jan. 9, 2001, now Pat. No. 6,578,736.

(51) Int. Cl.

| | |
|---|---|
| ***B65D 83/00*** | (2006.01) |
| ***B65D 71/36*** | (2006.01) |
| ***A47F 5/11*** | (2006.01) |
| ***A47F 1/12*** | (2006.01) |
| ***A47F 1/04*** | (2006.01) |

(52) U.S. Cl.

CPC ..... *A47F 1/12* (2013.01); *B65D 2571/0058* (2013.01); *B65D 71/36* (2013.01); *A47F 5/112* (2013.01); *B65D 2571/00141* (2013.01); *B65D 2571/0066* (2013.01); *B65D 2571/00549* (2013.01); *B65D 2571/0045* (2013.01); *B65D 2571/00728* (2013.01); *B65D 2571/00469* (2013.01); *A47F 1/04* (2013.01)

USPC ..... 221/305; 221/73

(58) Field of Classification Search

USPC ..... 221/305, 73

See application file for complete search history.

(56) References Cited

U.S. PATENT DOCUMENTS

| | | | |
|---|---|---|---|
| 902,347 | A | 10/1908 | Tillinghast |
| 1,541,143 | A | 6/1925 | Hoile |

(Continued)

FOREIGN PATENT DOCUMENTS

| | | |
|---|---|---|
| CA | 874828 | 7/1971 |
| CA | 2246020 | 2/2000 |

(Continued)

OTHER PUBLICATIONS

"Dispensing Multipack, Coke Canner Rolls Out 'Fridge-Friendly' Pack," Packaging World, Sep. 2001, p. 2, [Summit Publishing Company—Chicago].

(Continued)

*Primary Examiner* — Timothy Waggoner

(74) *Attorney, Agent, or Firm* — Womble Carlyle Sandridge & Rice, LLP

(57) ABSTRACT

A carton with an improved dispenser at one of the carton which preserves the integrity of the carton when the carton is opened by permitting a bottom end flap attached to the bottom panel to remain in place and also a portion of each side end flap that is adjacent to the bottom end flap. This dispenser may also provide a safety net for the first container that is automatically dispensed when the carton is opened.

18 Claims, 4 Drawing Sheets

(56) References Cited

U.S. PATENT DOCUMENTS

| | | | | |
|---|---|---|---|---|
| 1,925,102 | A | | 9/1933 | Levkoff |
| 2,124,808 | A | | 7/1938 | White et al. |
| 2,284,965 | A | | 9/1942 | Davidson |
| 2,294,964 | A | | 9/1942 | Davidson |
| 2,448,819 | A | | 9/1948 | Mitchell |
| 2,718,301 | A | * | 9/1955 | Palmer ..... 206/427 |
| 2,723,027 | A | | 11/1955 | Guyer |
| 2,754,047 | A | | 7/1956 | Schmidt et al. |
| 2,842,304 | A | | 7/1958 | Ringler |
| 2,868,431 | A | | 1/1959 | Painter |
| 2,919,844 | A | | 1/1960 | Anderson, Jr. |
| 2,930,516 | A | | 3/1960 | Fowle et al. |
| 2,975,891 | A | | 3/1961 | Stone |
| 2,990,097 | A | | 6/1961 | Thompson |
| 3,002,651 | A | | 10/1961 | Gauld |
| 3,018,031 | A | | 1/1962 | Ahlbor et al. |
| 3,178,242 | A | * | 4/1965 | Ellis et al. ..... 221/67 |
| 3,228,582 | A | | 1/1966 | Osberg |
| 3,263,861 | A | | 8/1966 | Carr |
| 3,265,283 | A | | 8/1966 | Farquhar |
| RE26,083 | E | | 9/1966 | Forrer |
| 3,300,115 | A | | 1/1967 | Schauer |
| 3,332,594 | A | | 7/1967 | De Capua |
| 3,356,279 | A | | 12/1967 | Root |
| 3,517,858 | A | | 6/1970 | Farquhar |
| 3,540,581 | A | | 11/1970 | Koolnis |
| 3,599,858 | A | | 8/1971 | Samsing |
| 3,669,251 | A | | 6/1972 | Phillips, Jr. |
| 3,765,527 | A | | 10/1973 | Vargo |
| 3,894,681 | A | * | 7/1975 | Arneson et al. ..... 221/305 |
| 3,913,739 | A | | 10/1975 | Hennessey |
| 3,933,303 | A | | 1/1976 | Kirby |
| 3,942,631 | A | | 3/1976 | Sutherland et al. |
| 4,000,811 | A | | 1/1977 | Hardison et al. |
| D243,508 | S | | 3/1977 | Killy |
| 4,030,596 | A | | 6/1977 | Snyder et al. |
| D252,259 | S | | 7/1979 | Rinehart |
| 4,214,660 | A | | 7/1980 | Hunt, Jr. |
| 4,216,861 | A | | 8/1980 | Oliff |
| 4,222,485 | A | | 9/1980 | Focke |
| D263,204 | S | | 3/1982 | Dutcher |
| 4,325,482 | A | | 4/1982 | Feeser |
| 4,331,289 | A | | 5/1982 | Killy |
| 4,364,509 | A | | 12/1982 | Holley, Jr. et al. |
| 4,375,258 | A | | 3/1983 | Crayne et al. |
| D269,068 | S | | 5/1983 | Mann, Sr. et al. |
| D270,041 | S | | 8/1983 | Vestal |
| 4,396,143 | A | | 8/1983 | Killy |
| 4,411,365 | A | | 10/1983 | Horikawa et al. |
| 4,416,410 | A | | 11/1983 | Herrmann |
| 4,417,661 | A | | 11/1983 | Roccaforte |
| 4,465,180 | A | | 8/1984 | Klygis |
| 4,498,581 | A | | 2/1985 | Dutcher |
| 4,519,522 | A | | 5/1985 | McElwee |
| 4,560,062 | A | | 12/1985 | Valiulis |
| 4,582,199 | A | | 4/1986 | Schuster |
| 4,588,084 | A | | 5/1986 | Holley, Jr. |
| 4,598,810 | A | | 7/1986 | Shore et al. |
| 4,605,128 | A | | 8/1986 | Rieke |
| D286,987 | S | | 12/1986 | Golan et al. |
| 4,706,876 | A | | 11/1987 | Wilson |
| 4,726,471 | A | | 2/1988 | Whately et al. |
| 4,756,419 | A | | 7/1988 | Le Bras |
| 4,785,991 | A | | 11/1988 | Schuster |
| 4,817,866 | A | | 4/1989 | Wonnacott |
| D303,090 | S | | 8/1989 | Armor et al. |
| 4,860,944 | A | | 8/1989 | Wonnacott |
| 4,919,266 | A | | 4/1990 | McIntosh, Jr. et al. |
| 4,961,507 | A | | 10/1990 | Higgins |
| 4,966,324 | A | | 10/1990 | Steel |
| 4,972,991 | A | | 11/1990 | Schuster |
| 4,974,771 | A | | 12/1990 | Lavery |
| 4,981,253 | A | | 1/1991 | Quaintance |
| 5,002,186 | A | | 3/1991 | Cooper |
| 5,031,825 | A | | 7/1991 | Romagnoli |
| 5,067,615 | A | | 11/1991 | Davitian |
| 5,101,642 | A | | 4/1992 | Alexandrov |
| 5,123,589 | A | | 6/1992 | Cote |
| 5,137,211 | A | | 8/1992 | Summer et al. |
| 5,170,934 | A | | 12/1992 | Lemoine |
| D332,915 | S | | 2/1993 | Hoell et al. |
| 5,205,436 | A | | 4/1993 | Savage |
| 5,277,360 | A | | 1/1994 | DeMott |
| 5,279,440 | A | | 1/1994 | Fougeres et al. |
| 5,284,292 | A | | 2/1994 | Johnson |
| 5,333,734 | A | | 8/1994 | Stout et al. |
| 5,337,920 | A | | 8/1994 | Clausen |
| 5,368,194 | A | | 11/1994 | Oliff et al. |
| 5,372,299 | A | | 12/1994 | Edgerton, Jr. et al. |
| 5,402,933 | A | | 4/1995 | Behrmann |
| 5,427,242 | A | | 6/1995 | Oliff et al. |
| 5,465,831 | A | | 11/1995 | Smith |
| 5,505,372 | A | | 4/1996 | Edson et al. |
| 5,518,111 | A | | 5/1996 | Stout |
| 5,622,309 | A | | 4/1997 | Matsuda et al. |
| 5,722,584 | A | | 3/1998 | Fujiwara |
| 5,775,574 | A | | 7/1998 | Whitnell |
| 5,788,117 | A | | 8/1998 | Zimmanck |
| 5,826,783 | A | | 10/1998 | Stout |
| 5,833,118 | A | | 11/1998 | Weiss |
| 5,873,515 | A | | 2/1999 | Dunn et al. |
| 5,878,947 | A | * | 3/1999 | Hoy et al. ..... 221/305 |
| 5,881,884 | A | | 3/1999 | Podosek |
| 6,105,854 | A | | 8/2000 | Spivey et al. |
| D436,859 | S | | 1/2001 | Botsford et al. |
| 6,176,419 | B1 | | 1/2001 | Holley, Jr. |
| 6,283,293 | B1 | | 9/2001 | Lingamfelter |
| D454,784 | S | | 3/2002 | Oram |
| 6,386,369 | B2 | | 5/2002 | Yuhas et al. |
| 6,435,351 | B1 | | 8/2002 | Gibb |
| 6,478,219 | B1 | | 11/2002 | Holley, Jr. |
| 6,484,903 | B2 | | 11/2002 | Spivey et al. |
| 6,550,615 | B2 | | 4/2003 | Lingamfelter |
| 6,578,736 | B2 | | 6/2003 | Spivey |
| 6,631,803 | B2 | | 10/2003 | Rhodes et al. |
| 6,715,639 | B2 | | 4/2004 | Spivey |
| 6,866,185 | B2 | | 3/2005 | Harrelson |
| 7,059,494 | B2 | | 6/2006 | Harrelson et al. |
| 7,100,798 | B2 | | 9/2006 | Spivey |
| 7,175,047 | B2 | | 2/2007 | Spivey |
| 7,523,842 | B2 | | 4/2009 | Spivey |
| 7,946,451 | B2 | | 5/2011 | Spivey |
| 8,123,072 | B2 | | 2/2012 | Spivey |
| 8,302,811 | B2 | | 11/2012 | Spivey |
| 2002/0070139 | A1 | | 6/2002 | Bates |
| 2002/0185499 | A1 | | 12/2002 | Harrelson et al. |
| 2002/0185527 | A1 | | 12/2002 | Bates |
| 2003/0141353 | A1 | | 7/2003 | Wilson |
| 2003/0192907 | A1 | | 10/2003 | Bates |
| 2004/0060972 | A1 | | 4/2004 | Harrelson |

FOREIGN PATENT DOCUMENTS

| | | | |
|---|---|---|---|
| DE | 2323589 | | 11/1974 |
| DE | 75 10 538 | | 8/1975 |
| DE | 76 06 493 | U1 | 6/1976 |
| DE | 29 33 022 | C2 | 2/1980 |
| DE | 81 35 176 | U1 | 5/1982 |
| DE | 8514718.4 | | 8/1985 |
| DE | 8629664.7 | | 11/1986 |
| DE | 3612594 | A1 | 10/1987 |
| DE | 30 07 769 | C2 | 9/1991 |
| DE | 40 23 043 | A1 | 12/1991 |
| DE | 94 12 885 | U1 | 10/1994 |
| DE | 94 13 813 | U1 | 10/1994 |
| DE | 295 19 931 | U1 | 2/1996 |
| DE | 296 02 010 | U1 | 3/1996 |
| DE | 299 09 008 | U1 | 9/1999 |
| DE | 29913585 | U1 | 10/1999 |
| DE | 694 21 620 | T2 | 4/2000 |
| EP | 235 852 | B1 | 9/1987 |
| EP | 0 323 596 | A1 | 7/1989 |
| EP | 0 342 088 | A1 | 11/1989 |
| EP | 0475147 | A1 | 3/1992 |

(56) References Cited

FOREIGN PATENT DOCUMENTS

| | | | |
|---|---|---|---|
| EP | 0 659 143 | | 6/1995 |
| EP | 0 752 370 | A2 | 1/1997 |
| EP | 0849189 | A1 | 6/1998 |
| EP | 0 936 995 | | 8/1999 |
| EP | 1 060 998 | A2 | 12/2000 |
| FR | 2 683 207 | | 5/1993 |
| GB | 2 186 550 | | 8/1987 |
| JP | 7-9721 | | 7/1993 |
| WO | WO-88/09750 | | 12/1988 |
| WO | WO-95/25668 | | 9/1995 |
| WO | WO-96/29260 | A1 | 9/1996 |
| WO | WO-97/21607 | | 6/1997 |
| WO | WO-9831593 | A1 | 7/1998 |
| WO | WO-99/64301 | A1 | 12/1999 |
| WO | WO-00/23334 | | 4/2000 |
| WO | WO-00/71428 | A1 | 11/2000 |
| WO | WO-01/28871 | A1 | 4/2001 |
| WO | WO-02/04302 | A1 | 1/2002 |
| WO | WO-02/085739 | A1 | 10/2002 |

OTHER PUBLICATIONS

"Hot Hit With Consumers," International Bottler & Packer, Nov. 2001 [Binstead Publications Ltd.].

"Coke Bottler Tests a Slimmer Soda Package", Wall Street Journal B3 (Aug. 10, 2001).

"Passing the Torch", Beverage World p. 36 (Oct. 2002).

"Riverwood" for the Carton Designated as 'Fridge Pack,' International Bottler & Packer, Nov. 2001 [Binstead Publications Limited—United Kingdom].

"Coca-Cola Fridge Mate", p. 3 Revise Woolworth's Advertisement wca4000 / N1A.

"*Riverwood International Corporation* v. *MeadWestvaco Corporation*" Civ. Action No. 1:03CV1672 (Jun. 17, 2003 N.D. Ga.) Plaintiff's [Riverwood] Motion for Prelim. Injunction.

"*Riverwood International Corporation* v. *MeadWestvaco Corporation*" Civ. Action No. 1:03CV1672 (N.D. Ga.) Defendant's [MeadWestvaco] Memorandum in Opposition to Plaintiff's [Riverwood] Motion for a Preliminary Injunction.

"*Riverwood International Corporation* v. *MeadWestvaco Corporation*" Civ. Action No. 1:03CV1672 (N.D. Ga.) Plaintiff's [Riverwood] Reply to Defendant's [MeadWestvaco] Memorandum in Opposition to Plaintiff's [Riverwood] Motion for a Preliminary Injunction.

"*Riverwood International Corporation* v. *Meadwestvaco Corporation*," Civ. Action No. 1:03-CV-1672 (TWT) (N.D. Ga.), Riverwood's Supplemental Pre-Hearing Brief in Support of Plaintiff's [Riverwood] Motion for Preliminary Injunction.

"*Riverwood International Corporation* v. *Meadwestvaco Corporation*," Civ. Action No. 1:03-CV-1672 (TWT) (N.D. Ga.), Meadwestvaco's Supplemental Memorandum in Opposition to Riverwood's Motion for a Preliminary Injunction.

The American College Dictionary, Copyright 1961, by Random House, Inc., p. 836.

*Graphic Packaging International, Inc.* v. *C. Brown Lingamfelter*, Civil Action No. 1-04-CV-0842 (JEC) (USDC N.D.GA), Memorandum in Support of Conditional Motion to Stay Proceeding Pending *Inter Partes* Reexamination of U.S. Patent No. 6,789,673, filed Jan. 25, 2005, on behalf of Graphic Packaging International, Inc., pp. 1 and 3.

*C. Brown Lingamfelter* v. *David J. Kappos et al.*, United States Court of Appeals for the Federal Circuit, Appeal No. 2011-1449, Appeal from the United States Patent and Trademark Office, Board of Patent Appeals and Interferences, Decided: Aug. 9, 2012.

*The C.W. Zumbiel Company, Inc.* v. *David J. Kappos et al.*, United States Court of Appeals for the Federal Circuit, Appeal Nos. 2011-1332, -1333, Appeal from the United States Patent and Trademark Office, Board of Patent Appeals and Interferences, Decided: Dec. 27, 2012.

* cited by examiner

CARTON WITH AN IMPROVED DISPENSING FEATURE

CROSS-REFERENCE TO RELATED APPLICATIONS

This application is a continuation of U.S. patent application Ser. No. 13/662,876, filed Oct. 29, 2012, which is a continuation of U.S. patent application Ser. No. 13/357,997, filed Jan. 25, 2012, now U.S. Pat. No. 8,302,811, which is a continuation of U.S. patent application Ser. No. 13/094,962, filed Apr. 27, 2011, now U.S. Pat. No. 8,123,072, which is a continuation of U.S. patent application Ser. No. 12/406,537, filed Mar. 18, 2009, now U.S. Pat. No. 7,946,451, which is a continuation of U.S. patent application Ser. No. 11/470,428, filed Sep. 6, 2006, now U.S. Pat. No. 7,523,842, which is a continuation of U.S. patent application Ser. No. 10/959,870, filed Oct. 6, 2004, now U.S. Pat. No. 7,175,047, which is a continuation of U.S. patent application Ser. No. 10/777,614, filed Feb. 12, 2004, now U.S. Pat. No. 7,100,798, which is a continuation of U.S. patent application Ser. No. 10/425,846, filed Apr. 29, 2003, now U.S. Pat. No. 6,715,639, which is a continuation of U.S. patent application Ser. No. 09/757,714, filed Jan. 9, 2001, now U.S. Pat. No. 6,578,736, which are incorporated herein by reference in their entirety.

BACKGROUND OF THE INVENTION

1. Field of the Invention

The present invention relates generally to an enclosed paperboard carton capable of enclosing containers, which carton has a unique opening and dispensing feature that allows the containers, for example, cans or bottles, to be removed or dispensed without destroying the overall structural integrity of the carton. The dispensing feature may also provide a safety net for the first container that is automatically dispensed when the carton is opened. This dispensing feature also permits the carton to be carried from one location to another after the dispenser has been opened without the containers falling out of the carton.

2. Background

Fully enclosed carton capable of enclosing cans have been used in the past that have a feature for dispensing the cans one at a time. Dispenser sections have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

In effect, many of these dispensers destroy the overall carton integrity once they have been opened. Many of these dispensing features do not have any means for preventing the first container that is automatically dispensed from falling free from the carton. In other words, its dispensing feature has no safety net.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an accurate flap portion extending downwardly in the end wall into the center of the aperture. The structural integrity of this carton is compromised because the entire bottom end of the carton is opened. The dispensing flap does not provide a safety net to prevent a can from rolling out of the carton and falling to the floor. This carton cannot be easily moved from one location to another after the dispenser has been opened without the containers falling out. It will be realized that the design of this carton is not satisfactory for dispensing bottles with necks as the exiting container being dispensed needs to have a corresponding cylindrical top and bottom of approximately the same size to facilitate easy dispensing by a person grasping the ends of the exiting container.

U.S. Pat. No. 4,364,509 to Holley, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the exiting can. This carton is not adapted for use with bottles, because of the necessity of grasping the ends of the container for removal. In addition, it is not adapted for carrying cans once the carton has been opened as they are likely to roll out of the dispenser. There is also no safety net to receive the cans as they are rolled out of the dispenser.

SUMMARY OF THE INVENTION

It is an object of this invention to provide a dispenser that preserves the integrity of the carton after the dispenser has been opened. It is a further object to provide a dispenser that can be used with both cans and bottles. It is another object of this invention to provide a safety net or basket for the containers that are automatically dispensed when the dispenser is opened. It is a still further object of this invention is to develop a dispenser that will permit the carton to be moved from one location to another after it has been opened without discharging containers. The final object of this invention is to provide a dispenser that can be easily opened.

Briefly described, in a preferred form, the objects of this invention are achieved by providing an enclosed carton that has a unique dispenser in the exiting end of the carton. This carton is generally rectangular and has a bottom, a top, two sides, a closed end and an exiting end. The carton is foldably constructed from a blank having panels and flaps. The exiting end or ends of the carton permits containers to be taken from the carton via the dispenser.

This carton has a dispenser that is torn from an end of the carton by tearing an end portion of the top panel, a triangular portion from the adjoining side panels, and all of the side end flaps except the bottom most portions, to form a dispenser. The top end flap is removed when this dispenser is opened. This dispenser may have a semi-circular score line attached to the dispenser score line in the top panel for easy opening of the dispenser. A person's fingers can be inserted between this semi-circular score line and the dispenser to commence the opening of the dispenser. This semi-circular score line is placed so that when it is pushed open, a person's fingers will go between the first and second containers inside of the carton. A score line can be provided that bisects the semi-circular score line parallel to the longitudinal axis of the containers to permit ease of entry of a person's fingers. The bottom portions of the side end flaps are left intact to preserve the structural integrity of the carton and also to provide a wall to prevent an end container in the bottom of the carton from accidentally rolling out.

It should be realized that the dispenser does not have to be totally removed from the carton, as the score lines in the side and top panels can be broken and the dispenser flipped over along the score lines in the side end flaps to form a safety net or basket when the first container in the top of the carton rolls out of the dispenser. If the score line in the side end flaps is not broken, the dispenser can be reclosed.

This carton can be constructed by gluing, taping, stapling and the like, or by locking. The dispenser of this invention can be put in one end of the carton or in both ends. A dispenser can be torn from the carton and placed under the other end of the carton to elevate it to facilitate the removal of the containers from the carton. These and other objects, features, and advantages of the present invention will become more apparent upon reading the following specification in conjunction with the accompanying drawing figures.

DETAILED DESCRIPTION OF THE PREFERRED EMBODIMENTS

Figure 1:
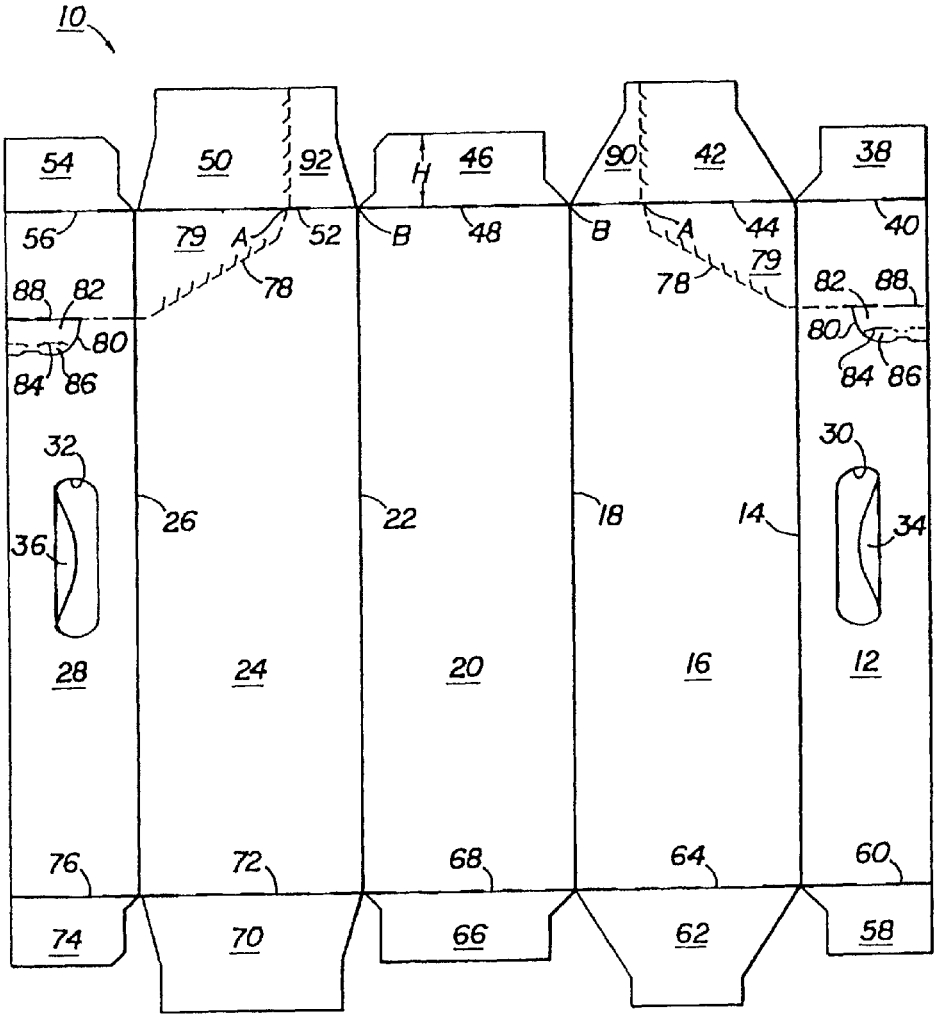
FIG. 1 is a plan view of a blank from which a carton according to this invention is formed.

The present invention is intended primarily for use with cans and bottles of the types used to contain soft drinks, beer and the like. The blank 10 is formed from a foldable sheet material, such as paperboard. The blank has a top flap 12 which is connected by fold line 14 to side panel 16, which in turn is connected by fold line 18 to bottom panel 20. Bottom panel 20 is connected by fold line 22 to side panel 24, which in turn is connected by fold line 26 to top flap 28.

This carton is capable of containing cans or bottles in two rows of six containers each. This carton has the "racetrack" handle 30 and 32 formed in the top flaps, 12 and 28, respectively. Cushioning flaps 34 and 36 are provided for the comfort of a person's hands, and are foldably joined to top flaps 12 and 28. On the exiting-end of the carton, top end flap 38 is joined to top flap 12 by fold line 40. Side end flap 42 is joined to side panel 16 by fold line 44. Bottom end flap 46 is joined to bottom panel 20 by fold line 48. Side end flap 50 is joined by fold line 52 to side panel 24. Top end flap 54 is joined to top flap 28 by fold line 56.

On the closed end of the carton, top end flap 58 is connected to top flap 12 by fold line 60, side end flap 62 is connected to side panel 16 by fold line 64, bottom end flap 66 is attached to bottom panel 20 by fold line 68, side end flap 70 is connected to side panel 24 by fold line 72 and top end flap 74 is connected to top flap 28 by fold line 76.

It will be understood by those skilled in the art that the carton of the present invention is generally symmetrical about a horizontal line of bisection, as viewed when FIG. 1 is rotated lengthwise. This symmetry aids in the efficient production of the present carton.

In forming this blank 10 into a carton, top flap 12 is glued to top flap 28 forming a sleeve. The cans or bottles are then loaded into the carton on their sides and the various end flaps on both ends are closed. Using one end as an example, top end flaps 38 and 54 are folded downwardly and bottom end flap 46 is folded upwardly and then side end flaps 42 and 50 are folded sideways. These various end flaps are held together by glue or other means. The other end of the carton is glued and closed in the same fashion.

When the blank is folded and glued, the resulting carton has a closed end and an exiting end. However, a dispenser can be placed on both ends of the cartons. The containers exit the carton through the exiting end of the carton. The exiting end of the carton has a tear line 78 that extends through the top flaps 12 and 28, through the side panels 16 and 24 to form a triangular dispensing flap on the dispenser 79 into the side end flaps 42 and 50. In order to facilitate the opening of this dispenser 79, a finger flap 82 may be provided for the easy insertion of the fingers to start the tearing of the dispenser 79. Finger flap 82 is connected to top flaps 12 and 28 by tear line 80. Finger flap 82 may be provided with insertion flap 86 to facilitate entry of the fingers into the carton. For the opening of the dispenser 79, insertion flap 86 is connected to finger flap 82 by fold line 84. Finger flap 82 and insertion flap 86 are connected to the dispenser 79 by fold line 88 which interrupts the tear line 78. It will be noticed that tear line 78 extends into side end flaps 42 and 50 so as to form a substantial bottom portion 90 and 92 so that the end of the carton will have a bottom end when the dispenser 79 is opened.

Figure 2:
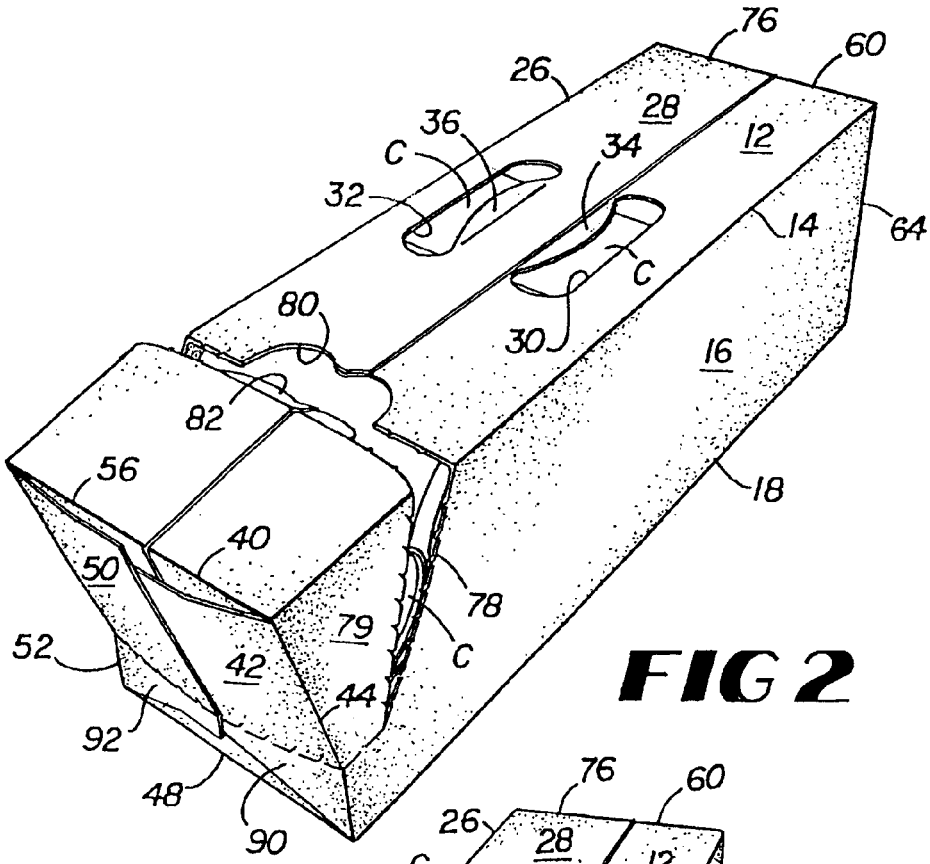
FIG. 2 is a perspective end view of the carton loaded with cans showing the dispenser being partially opened.

FIG. 2 shows the carton full of cans with the dispenser 79 open except for the tear lines 78 through the side end flaps 42, 50. It will be noted that the dispenser is a unitary structure. The dispenser 79 is opened by a person inserting his or her fingers into finger flap 82 and pulling the dispenser 79 open. Insertion flap 86 is provided to facilitate the entry of the fingers into the opening provided by finger flap 82. Finger flap 82 and insertion flap 86 are placed so that the fingers will enter the interior of the carton between the first and second cans.

Figure 3:
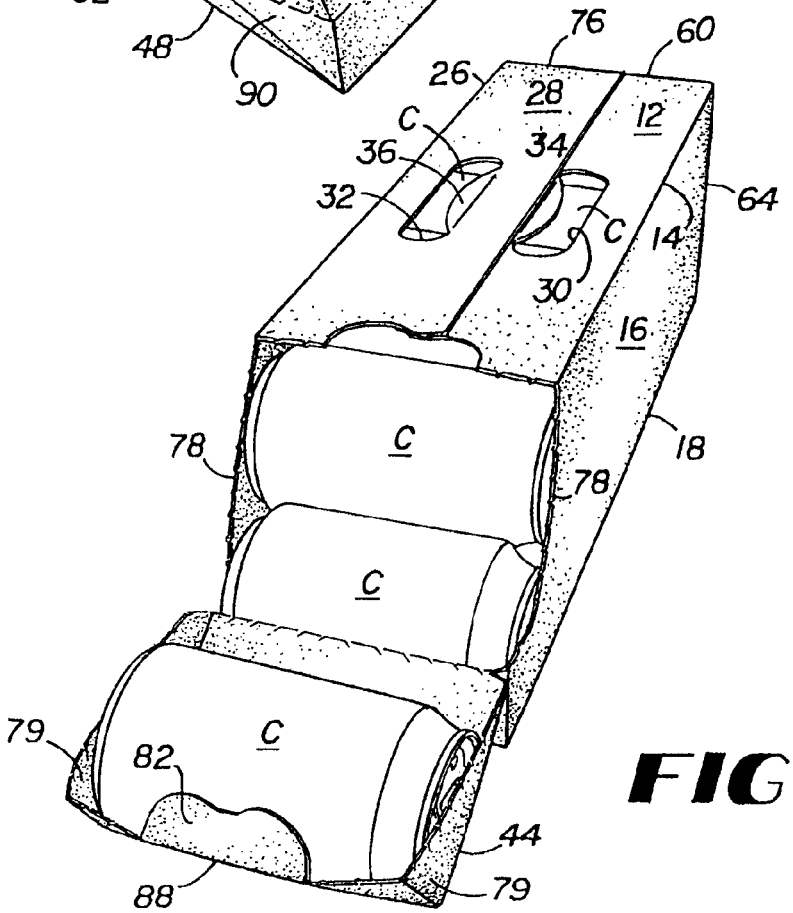
FIG. 3 is a perspective end view of the carton containing cans with the basket shaped dispenser open but attached and containing a can.

FIG. 3 shows the dispenser 79 completely opened but still attached to the carton by tear line 78 not being torn open through side end flaps 42 and 50. When the dispenser 79 is completely opened, the top can C will fall into the basket formed by the dispensing flap 79 and be retained. This dispenser 79 serves as a safety net to prevent the can from leaving the vicinity of the carton. The dispenser 79 forms a basket with triangular flaps forming side walls, side end flaps 42 and 50 forming a bottom wall and the torn off portions of the top flaps 12 and 28 forming an end wall.

Figure 4:
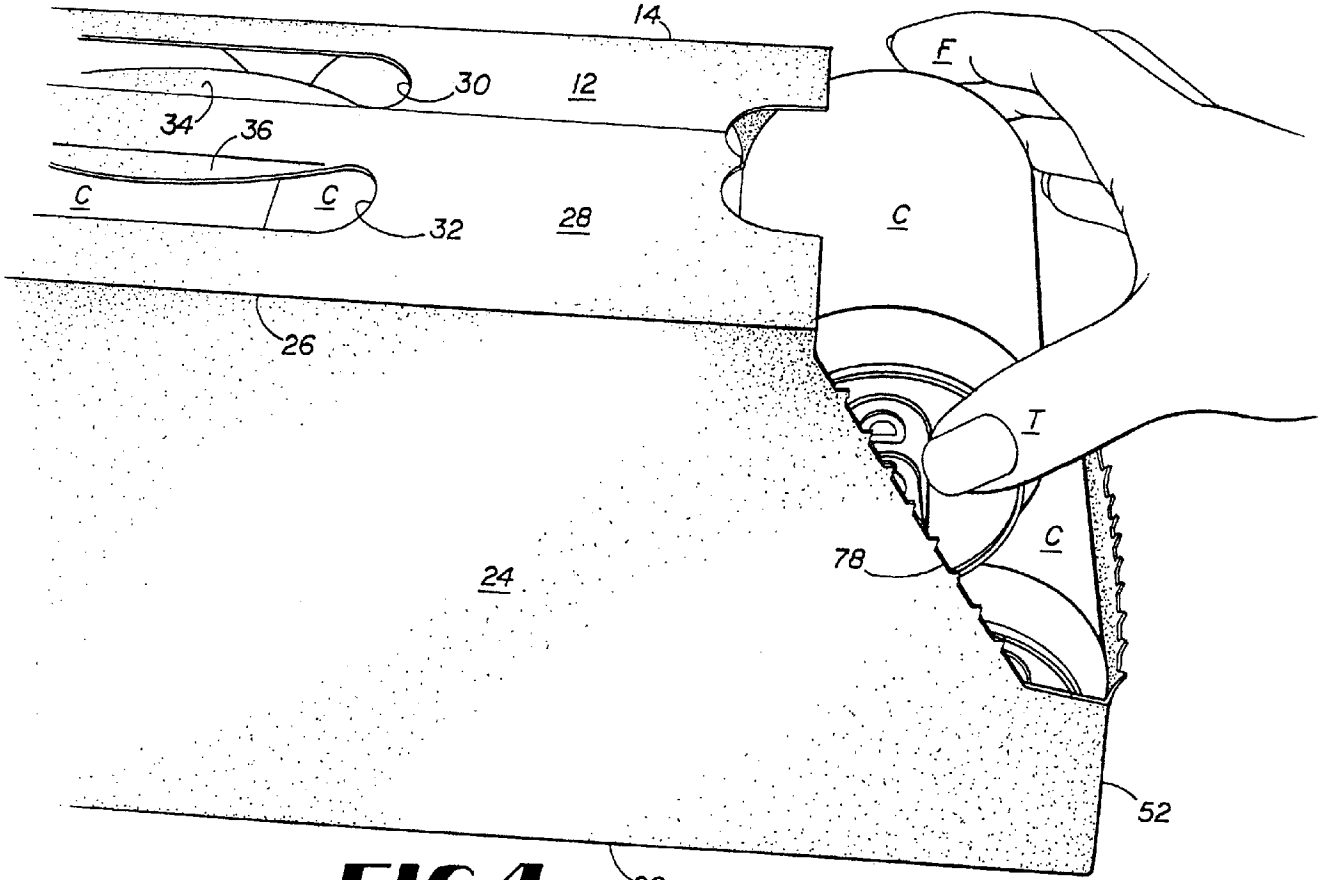
FIG. 4 is a perspective side view of the carton containing cans showing the top most end can being gripped by hand for removal from the carton.

In order to maintain the structural integrity of this carton, the bottom portions 90 and 92 of the side end flaps 42 and 50 are not removed from the carton when the dispenser is removed. The structural integrity of the carton is improved by the fact that the bottom end flap 46 is not removed. The bottom end flap 46 has a height H approximately equal to the distance between A and B along fold lines 44 and 52 respectively. This means that the bottom end flap 46 has the same height as the bottom portions 90 and 92 of the side end flaps 42 and 50, thus producing a strong bottom end structure. As shown in FIGS. 3 and 4, the height of the bottom end structure formed by 46, 90, and 92 is less than the diameter of a can C.

If desired, the dispenser 79 can be totally removed from carton or left attached along tear line 78 in side flaps 42 and 50 and reclosed.

As illustrated in FIG. 4, a can C can be easily removed from the carton by using the fingers F and the thumb T of a hand.

Figure 5:
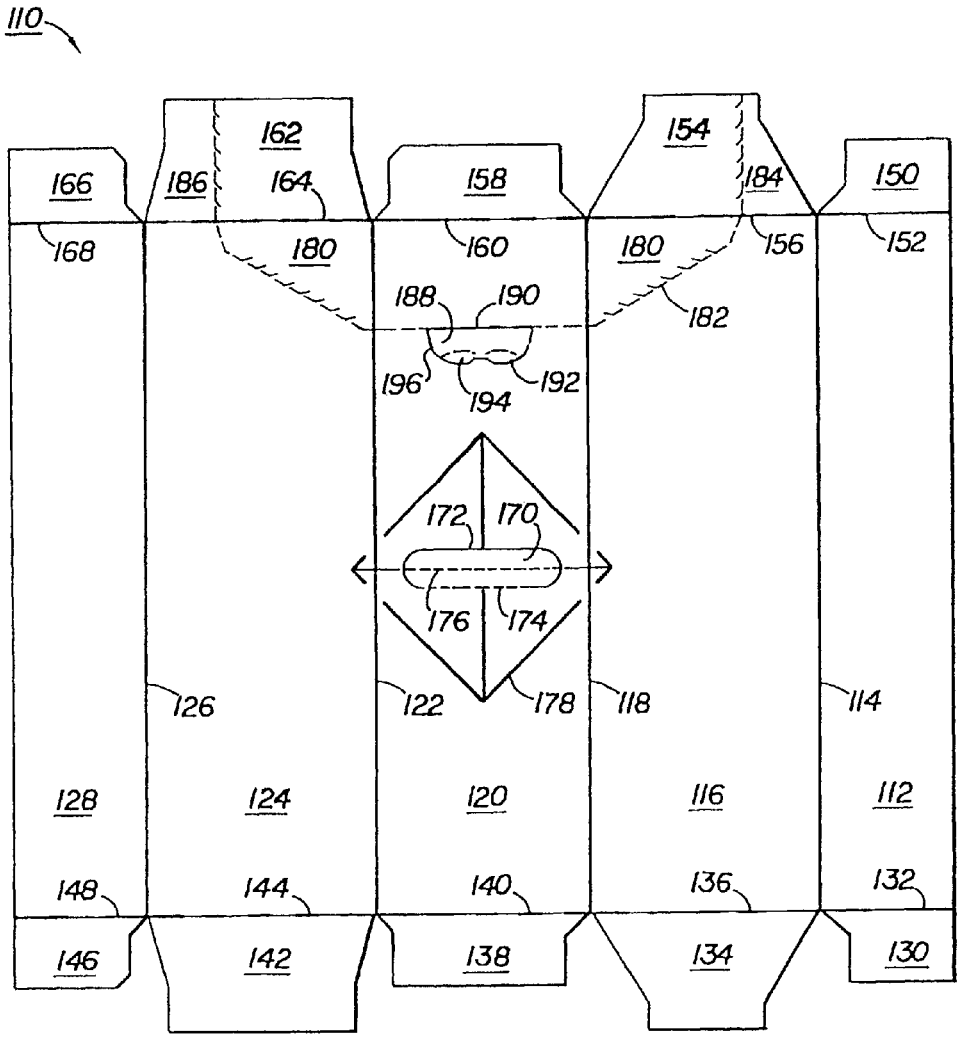
FIG. 5 is a plan view of the blank from which a carton according to this invention is formed having a single handle opening with the bottoms flaps being designed to be glued together.

FIG. 5 is a plan view of a blank from which a carton containing cans in three rows of four cans each according to the invention is formed. This carton has a single slot handle for carrying. The blank 110 has a bottom flap 112 which is connected by fold line 114 to side panel 116, which in turn is connected by fold line 118 to top panel 120. Top panel 120 in turn is connected by fold line 122 to side panel 124 which in turn is connected by fold line 126 to bottom flap 128. On the closed end of the carton, bottom end flap 130 is foldably connected by fold line 132 to bottom flap 112. Side end flap 134 is connected by fold line 136 to side panel 116. Top end flap 138 is connected by fold line 140 to top panel 120. Side end flap 142 is connected by fold line 144 to side panel 124 and bottom end flap 146 is connected by fold line 148 to bottom flap 128. The exiting end of the carton has a bottom end flap 150 which is connected to bottom flap 112 by fold line 152. Side end flap 154 is connected by fold line 156 to side panel 116. Top end flap 158 is connected by fold line 160 to top panel 120. Side end flap 162 is connected by fold line 164 to side panel 124. Bottom end flap 166 is connected by fold line 168 to bottom flap 128.

This carton has a slot handle 170 formed by cut line 172 and fold lines 174 and 176. It also has a score line 178 to assist in dissipating the forces involved in lifting a loaded carton.

A dispenser 180 is formed by tearing tear line 182 which extends from the top panel 120 through side panels 116, 124 and into side end flaps 154 and 162. Tear line 182 extends into side end flaps 154 and 162, so as to leave bottom portions 184, 186 that has a height when the carton is formed along lines 156, 164 respectively that is approximately equal to the height of bottom end flaps 150 and 166 in order to provide structural strength to the carton. This carton may have a finger flap 188 connected to dispenser 180 by fold line 190 and insertion flap 192 connected to finger flap 188 by fold line 194. Finger flap 188 and insertion flap 192 are joined to top panel 120 by tear line 196.

A sleeve from this carton is prepared by gluing the bottom flap 112 and 128 in an overlapping relationship. This carton is then loaded in the same manner as the carton shown in FIG. 2 through as the end of the cartons. Side end flaps 134, 142, 154, and 162 are glued over the bottom end flaps 130, 146, 150, 166 and top end flaps 138 and 158 to close the ends of the carton. The dispenser is opened in the same manner as the dispenser shown in FIGS. 1 and 2.

The dispenser of this invention can be used for both cans and other types of cylindrical containers. It is particularly useful for PET bottles having a stubby configuration.

Unique Features of the Dispenser of this Invention

One of the unique features of the dispenser of this invention is that it provides easy access to the cans or bottles in the carton but yet does not greatly diminish the structural integrity of the carton. This is partly because the bottom end of the end panel in which the dispenser is located is retained. This accomplished by leaving a bottom portion on the side end panel that is equal in height to the bottom end flaps.

The dispenser of this invention provides an easy opening feature in that it has a finger flap and insertion flap so that a person's fingers can be inserted between the first and second can to open the dispenser.

This dispenser also provides a safety net or basket in that if the tear line for the dispenser is not torn along the side end flaps, it remains attached to the carton and can catch in its basket a can as it is removed from the carton.

While the invention has been disclosed in its preferred forms, it will be apparent to those skilled in the art that many modifications, additions, and deletions can be made therein without departing from the spirit and scope of the invention and its equivalents as set forth in the following claims.

I claim:

1. An enclosed carton for carrying a plurality of containers in two rows, with a top row and a bottom row, said containers each having a diameter and an axis, the containers in the top row including a first container and a second container, the second container contacting the first container; the carton comprising:

a top panel, a first side panel, a second side panel, a bottom panel, and closed ends, at least one of which is an exiting end; the exiting end being formed of end flaps; the first container contacting the exiting end; the containers in the bottom row including an end container; the end container contacting the exiting end;

a dispenser which can be flipped over at the exiting end to form an opening through which the containers may be removed;

the dispenser comprising portions of the carton; the portions including a portion of the top panel, a portion of the first side panel, a portion of the second side panel, and a portion of the exiting end; said portions being defined by a tear line extending across the top panel, the first side panel, the second side panel, and the exiting end;

the tear line extending across the top panel spaced between the axis of the first container and the axis of the second container; the tear line in the exiting end extending the entirety of the distance between the first side panel and the second side panel;

a finger flap located along the tear line in the top panel; the finger flap is located between the axis of the first container and the axis of the second container;

the tear line in the exiting end separating the portion of the exiting end comprising the dispenser from a bottom end structure; the bottom end structure having a height above the bottom panel that is less than the diameter of said end container; and wherein, when the dispenser is flipped over along the tear line in the exiting end, a basket is formed, the basket catching the first container as the dispenser is flipped over along the tear line in the exiting end.

2. The carton of claim 1 wherein the first container is moved with the dispenser as the dispenser is being flipped over along the tear line in the exiting end.

3. The carton of claim 1 wherein the dispenser can be reclosed.

4. The carton of claim 1 wherein the containers are cans or bottles.

5. The carton of claim 1 wherein the first container has a diameter at its largest section, and wherein at least a portion of the tear line in the top panel is spaced from the exiting end more than the diameter of the first container.

6. The carton of claim 1 wherein when the carton is disposed on a substantially flat surface, the dispenser can be detached from the top panel and opened to contact the surface without detaching the dispenser from the exiting end.

7. The carton of claim 1 in which the dispenser remains attached to the carton when the dispenser is flipped over along the tear line in the exiting end.

8. The carton of claim 1 which is only capable of carrying six containers in the top row and six containers in the bottom row.

9. The carton of claim 1 wherein the tear line in the exiting end is spaced from the bottom panel less than a diameter of the end container in the bottom row.

10. The carton of claim 1 wherein structural integrity of the carton is preserved after the dispenser has been separated along the tear line in the top panel, in the first side panel, and in the second side panel.

11. The carton of claim 1 wherein each of the containers in the top row is positioned directly above a corresponding container in the bottom row.

12. The carton of claim 1 wherein the end container has a diameter and wherein the tear line in the exiting end is located a height from the bottom panel that is less than the diameter.

13. The carton of claim 1 wherein the carton does not include cut lines for receiving adhesive on the first side panel or the second side panel.

14. The carton of claim 1 wherein, after dispensing the first container, the dispenser can be pivoted toward the top panel to reclose the dispenser.

15. The carton of claim 1 wherein the enclosed carton is not adhesively attached to another carton.

16. The carton of claim 1 wherein the tear line across the exiting end forms a single tear line entirely across the exiting end.

17. The carton of claim 1 further comprising a handle in the carton, and wherein the handle is not in the exiting end.

18. An enclosed carton for carrying a plurality of containers in two rows, with a top row and a bottom row, said containers each having a diameter and an axis, the containers in the top row including a first container and a second container, the second container contacting the first container; the carton comprising:

a top panel, a first side panel, a second side panel, a bottom panel, and closed ends, at least one of which is an exiting end; the exiting end being formed of end flaps; the first container contacting the exiting end; the containers in the bottom row including an end container; the end container contacting the exiting end;

a dispenser which can be flipped over at the exiting end to form an opening through which the containers may be removed;

the dispenser comprising portions of the carton; the portions including a portion of the top panel, a portion of the first side panel, a portion of the second side panel, and a portion of the exiting end; said portions being defined by a tear line extending across the top panel, the first side panel, the second side panel, and the exiting end;

the tear line extending across the top panel spaced between the axis of the first container and the axis of the second container; the tear line in the exiting end extending the entirety of a distance between the first side panel and the second side panel;

the tear line in the exiting end separating the portion of the exiting end comprising the dispenser from a bottom end structure; the bottom end structure having a height above the bottom panel that is less than the diameter of said end container; and wherein, when the dispenser is flipped over along the tear line in the exiting end, a basket is formed, the basket catching the first container as the dispenser is flipped over along the tear line in the exiting end; and wherein the tear line is contiguous to form a closed loop.

* * * * *